US008529083B1

(12) United States Patent
Reed et al.

(10) Patent No.: US 8,529,083 B1
(45) Date of Patent: Sep. 10, 2013

(54) MULTI-DIRECTIONAL FIREARM LIGHT

(76) Inventors: Talon J. Reed, Jacksonville, OR (US); Shane A. Reed, Jacksonville, OR (US)

( * ) Notice: Subject to any disclaimer, the term of this patent is extended or adjusted under 35 U.S.C. 154(b) by 259 days.

(21) Appl. No.: 13/160,684

(22) Filed: Jun. 15, 2011

(51) Int. Cl.
*F41G 1/34* (2006.01)

(52) U.S. Cl.
USPC ..... 362/110; 362/112

(58) Field of Classification Search
USPC ..... 362/110, 112, 184, 474; 42/117, 42/146
See application file for complete search history.

(56) References Cited

U.S. PATENT DOCUMENTS

| | | | | |
|---|---|---|---|---|
| 1,189,670 | A | 7/1916 | Derryberry | |
| 1,252,270 | A | 4/1918 | Schmidt et al. | |
| 5,558,430 | A * | 9/1996 | Booty, Jr. | 362/184 |
| 5,810,466 | A | 9/1998 | Young | |
| 5,971,562 | A * | 10/1999 | Yang | 362/184 |
| 6,206,541 | B1 * | 3/2001 | Landamia | 362/184 |
| 6,463,947 | B1 | 10/2002 | Wipperfurth | |
| 7,222,986 | B2 | 5/2007 | Mah | |
| 7,784,479 | B2 | 8/2010 | Navvarro | |
| 2002/0149928 | A1 * | 10/2002 | Watterson et al. | 362/184 |
| 2004/0090775 | A1 * | 5/2004 | Hsien | 362/184 |
| 2010/0164401 | A1 * | 7/2010 | Matthews et al. | 315/294 |

* cited by examiner

*Primary Examiner* — Evan Dzierzynski
(74) *Attorney, Agent, or Firm* — Jerry Haynes Law

(57) ABSTRACT

A multi-directional firearm light includes a firearm light housing, at least one light mount rail carried by the firearm light housing, a front light carried by the firearm light housing, at least one side light carried by the firearm light housing and disposed at an angle with respect to the front light, a power source connected to the front light and the at least one side light and at least one switch connected to the front light, the at least one side light and the power source.

15 Claims, 3 Drawing Sheets

MULTI-DIRECTIONAL FIREARM LIGHT

FIELD OF THE INVENTION

The disclosure generally relates to lights for firearms. More particularly, the disclosure relates to a multi-directional firearm light which can be attached to a firearm to illuminate areas at the front and sides of the firearm when the firearm is used in a dark or dimly-lit environment.

BACKGROUND OF THE INVENTION

Some conventional firearms are equipped with an accessory rail which extends along the barrel of the firearm. Various accessories may be attached to the accessory rail to expand the functional capabilities of the firearm. In situations in which the firearm is to be used in a dark or dimly-lit environment, a firearm light may be attached to the accessory rail to illuminate the area in front of the firearm and enable a user of the firearm to visualize a target or potentially dangerous persons in the environment.

A conventional firearm light includes a housing fitted with light mount rails which engage the companion accessory rails on the barrel of the firearm. A single front light is provided at the front of the housing. Therefore, a common problem which is associated with conventional firearm lights is that the areas to the sides of the firearm are not illuminated. Therefore, potential targets or persons who may be a danger to the user of the firearm may remain undetected by the firearm user at the side or sides of the firearm.

Accordingly, a multi-directional firearm light which can be attached to a firearm to illuminate areas at the front and sides of the firearm when the firearm is used in a dark or dimly-lit environment is needed.

SUMMARY OF THE INVENTION

The disclosure is generally directed to a multi-directional firearm light. An illustrative embodiment of the multi-directional firearm light includes a firearm light housing, at least one light mount rail carried by the firearm light housing, a front light carried by the firearm light housing, at least one side light carried by the firearm light housing and disposed at an angle with respect to the front light, a power source connected to the front light and the at least one side light and at least one switch connected to the front light, the at least one side light and the power source.

In some embodiments, the multi-directional firearm light may include a firearm light housing; a pair of side light openings in respective sides of the firearm light housing; at least one light mount rail carried by the firearm light housing; a front light carried by the firearm light housing; a pair of side lights carried by the firearm light housing in the respective side light openings, each of the pair of side lights disposed at an angle with respect to the front light; a power source connected to the front light and the pair of side lights; and at least one switch connected to the front light, the pair of side lights and the power source.

In some embodiments, the multi-directional firearm light may include a generally elongated firearm light housing having a bottom housing panel, side housing panels extending from the bottom housing panel, a top housing panel carried by the side housing panels and front and rear housing panels on the bottom housing panel, the side housing panel and the rear housing panel; at least one light mount rail carried by the top housing panel of the firearm light housing; a pair of side light openings in respective side housing panels of the firearm light housing; a front light carried by the front housing panel of the firearm light housing; a pair of side lights in the pair of side light openings, respectively, of the firearm light housing and each disposed at an angle of between about 20 degrees and about 90 degrees with respect to the front light; a power source connected to the front light and the side lights; and at least one switch connected to the front light, the side lights and the power source.

BRIEF DESCRIPTION OF THE DRAWINGS

The disclosure will now be made, by way of example, with reference to the accompanying drawings, in which.

DETAILED DESCRIPTION

Figure 1:
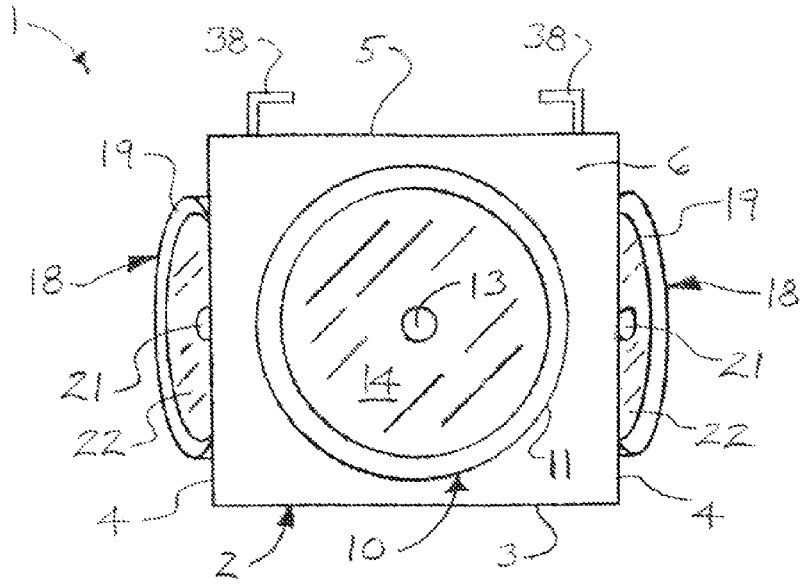
FIG. 1 is a front view of an illustrative embodiment of the multi-directional firearm light.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. It is to be understood that relative terms such as "front", "rear", "top", "bottom" and "side" as used herein are descriptive only and are not to be construed in a limiting sense.

Referring initially to FIGS. 1-5 of the drawings, an illustrative embodiment of the multi-directional firearm light, hereinafter firearm light, is generally indicated by reference numeral 1. The firearm light 1 includes a firearm light housing 2 which may be generally elongated and may be plastic, metal and/or other material which is consistent with the functional requirements of the firearm light 1. In some embodiments, the firearm light housing 2 may have a generally square cross-section and includes a bottom housing panel 3, a pair of spaced-apart side housing panels 4 extending from the bottom housing panel 3, a top housing panel 5 on the side housing panels 4 and a front housing panel 6 and a rear housing panel 7. In other embodiments, the firearm light housing 2 may be generally cylindrical or may have any other shape which is consistent with the functional requirements of the firearm light housing 1. At least one light mount rail 38, the purpose of which will be hereinafter described, may be provided on the top housing panel 5 of the firearm light housing 2.

A front light 10 is provided on the firearm light housing 2. The front light 10 may include a front light housing 11 which extends from the front housing panel 6 of the firearm light housing 2 and may be generally cylindrical. As illustrated in phantom in FIG. 5, a conical light reflective surface 12 (illustrated in phantom) may be provided in the front light housing 11. A light bulb 13 may be provided at the center of the light reflective surface 12. In some embodiments, the light bulb 13 may be a source of white lighting. In some embodiments, the light bulb 13 may include an LED. In some embodiment, the light bulb 13 may be adapted to emit infrared radiation. A transparent front light cover 14 may be provided on the front light housing 11 to enclose the light reflective surface 12 and the light bulb 13 in the front light housing 11.

Figure 5:
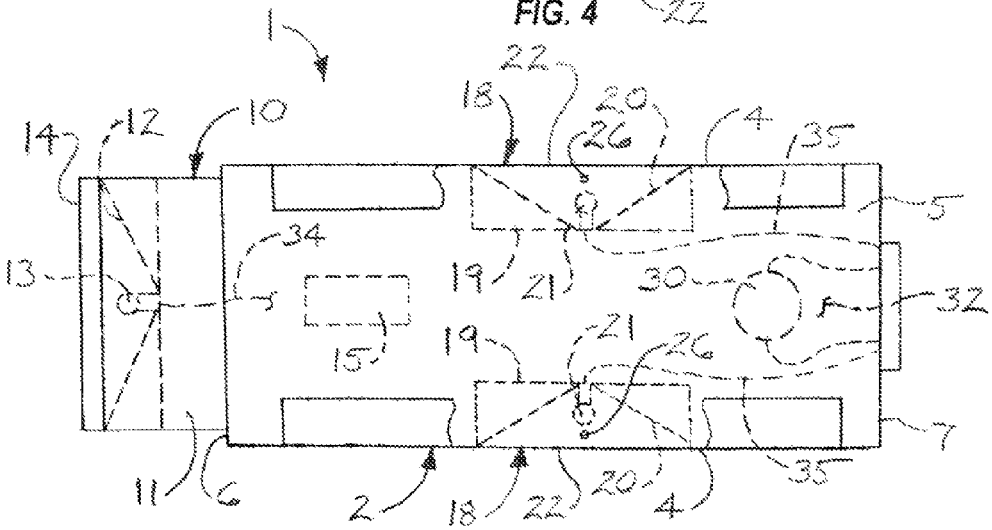
FIG. 5 is a top view of an illustrative embodiment of the multi-directional firearm light, more particularly illustrating various internal functional components (illustrated in phantom) of the multi-directional firearm light.

As illustrated in FIGS. 2-5, at least one side light 18 is provided on at least one side of the firearm light housing 2. In some embodiments, a pair of side lights 18 may be provided on respective sides of the firearm light housing 2, as illustrated. Each side light 18 may include a side light housing 19 which may be generally cylindrical and is attached to the firearm light housing 2 in a manner which will be hereinafter described. As illustrated in FIG. 5, a generally conical light reflective surface 20 may be provided in the side light housing 19 of each side light 18. A light bulb 21 may be provided at the center of the light reflective surface 12. In some embodiments, the light bulb 21 may be a source of white lighting. In some embodiments, the light bulb 21 may include an LED. In some embodiments, the light bulb 21 may be adapted to emit infrared radiation. A transparent side light cover 22 may be provided on the side light housing 19 to enclose the light reflective surface 20 and the light bulb 21 in the side light housing 19.

Figure 2:
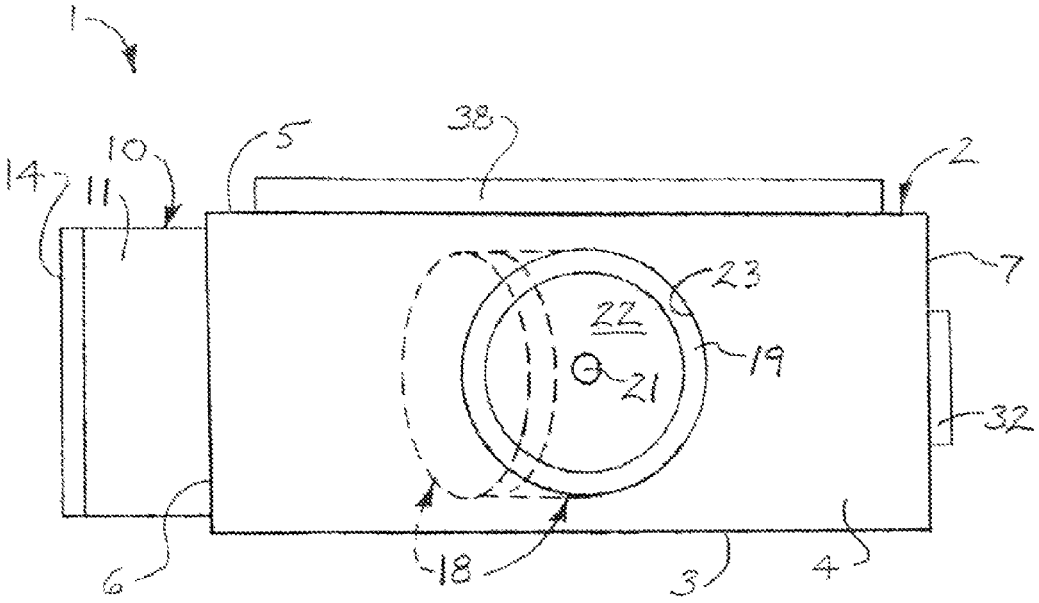
FIG. 2 is a side view of an illustrative embodiment of the multi-directional firearm light.
Figure 3:
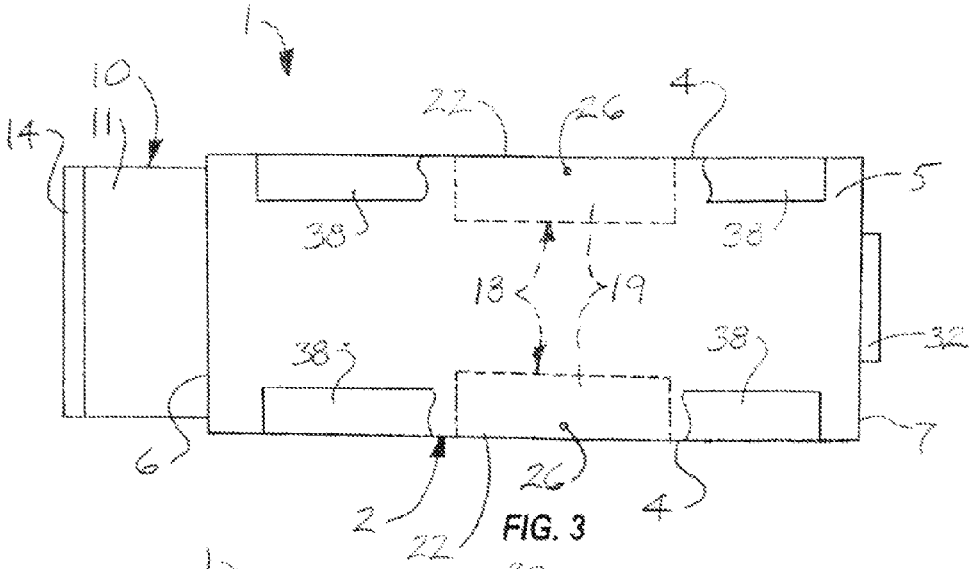
FIG. 3 is a top view of an illustrative embodiment of the multi-directional firearm light, more particularly illustrating a pair of recessed side lights (illustrated in phantom) oriented at a 90-degree angle with respect to a longitudinal axis of the firearm light housing.
Figure 4:
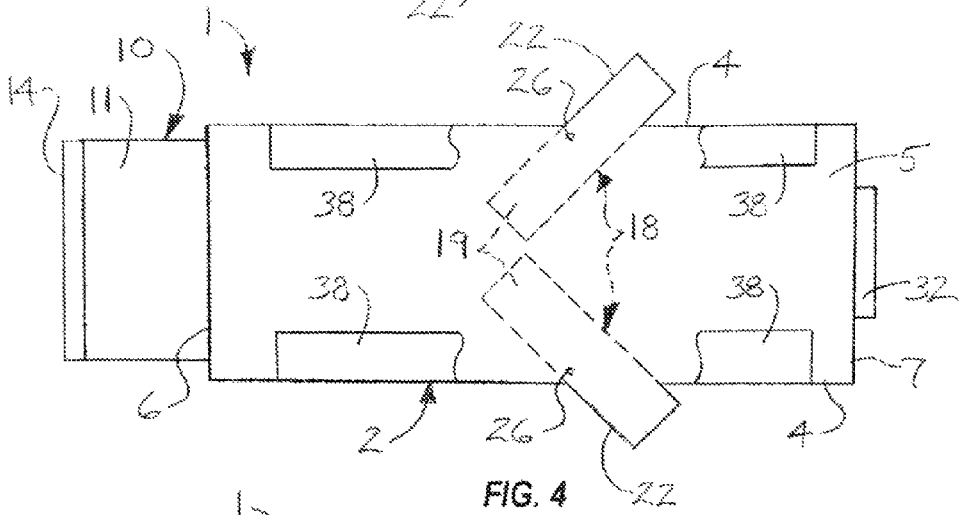
FIG. 4 is a top view of an illustrative embodiment of the multi-directional firearm light, with the side lights oriented forwardly at a 45-degree angle with respect to a longitudinal axis of the firearm light housing.

As illustrated in FIG. 2, in some embodiments, the side light housing 19 of each side light 18 may be mounted in a side light opening 23 which is milled, casted, molded or otherwise fabricated in the corresponding side housing panel 4 of the firearm light housing 2 according to the knowledge of those skilled in the art. As illustrated in FIGS. 3 and 5, in some embodiments, the side light housing 19 of each side light 18 may be pivotally attached to the firearm light housing 2 such as via a light pivot pin 26. Accordingly, each side light 18 may be capable of being selectively positioned such that the plane of the side light cover 22 on each side light 18 is disposed at a selected angle with respect to the plane of the front light cover 14 on the front light 10 (FIG. 3). In some embodiments, each side light 18 may be capable of being selectively positioned such that the plane of the side light cover 22 on each side light 18 is disposed at generally 90-degree angle with respect to the plane of the front light cover 14 on the front light 10 (FIG. 3), at a generally 20-degree angle with respect to the plane of the front light cover 14 on the front light 10 (FIG. 4), or at any angle there between. In other embodiments, the plane of the side light cover 22 may be adjustable to a greater than 90-degree angle or less than a 20-degree angle with respect to the plane of the front light cover 14. In other embodiments, each side light 18 may be deployed at a fixed angle with respect to the front light 10 such as at the 90-degree angle illustrated in FIG. 3, the 45-degree angle illustrated in FIG. 4 or any angle in between. In still other embodiments, each side light 18 may be disposed at any angle between a 20-degree angle and a 90-degree angle with respect to the plane of the front light cover 14 on the front light 10. In other embodiments, the plane of the side light cover 22 may be fixed at a greater than 90-degree angle or less than a 20-degree angle with respect to the plane of the front light cover 14. As illustrated in FIG. 3, when the side lights 18 are disposed in the 90-degree orientation, the side light cover 22 of each side light 18 may be generally flush or coplanar with the exterior surface of the firearm light housing 2. In some embodiments, each side light 18 may be recessed in the corresponding side light opening 23 (FIG. 2) in the firearm light housing 2.

As illustrated in FIG. 5, a power source such as at least one battery 30 may be provided in the firearm light housing 2. In some embodiments, the battery 30 may include at least one disposable battery. In other embodiments, the battery 30 may include at least one rechargeable battery. In some embodiments, the battery 30 may be a lithium battery. The battery 30 may be included in a battery compartment (not illustrated) which can be easily accessed on the exterior surface of the firearm light housing 2 such as through a removable cover (not illustrated) on the firearm light housing 2. A side light switch 32 is electrically connected to the light bulb 21 of each side light 18, typically via side light wiring 35, and is connected to the battery 30 to provide manual control of the side lights 18. In some embodiments, a front light switch 15 may be electrically connected to the light bulb 13 of the front light 10 via front light wiring 34 and to the battery 30 to provide separate manual control of the front light 10. In other embodiments, the front light switch 15 may be omitted and the side light switch 32 may be electrically connected to the light bulb 13 of the front light 10 typically via front light wiring 34.

The side light switch 32 may have any number of settings depending on the illumination sequence or configuration which is desired for the side lights 18. For example and without limitation, in some embodiments, the front light 10 may be energized independently of the side lights 18 by manipulation of the front light switch 15. The side light switch 32 may be a two-way light switch in which manipulation of the side light switch 32 to a first setting turns the side lights 18 off and manipulation of the light switch 32 to a second setting energizes both of the side lights 18 simultaneously. In other embodiments, the side light switch 32 may have settings which energize the side lights 18 one at a time (at a first setting) or simultaneously (at a second setting). In still other embodiments, the front light switch 15 may be omitted and the side light switch 32 may facilitate illumination of the front light 10 and the side lights 18 in any desired pattern or sequence. The front light switch 15 and the side light switch 32 may be provided in any easily accessible location on the exterior of the firearm light housing 2.

Figure 6:
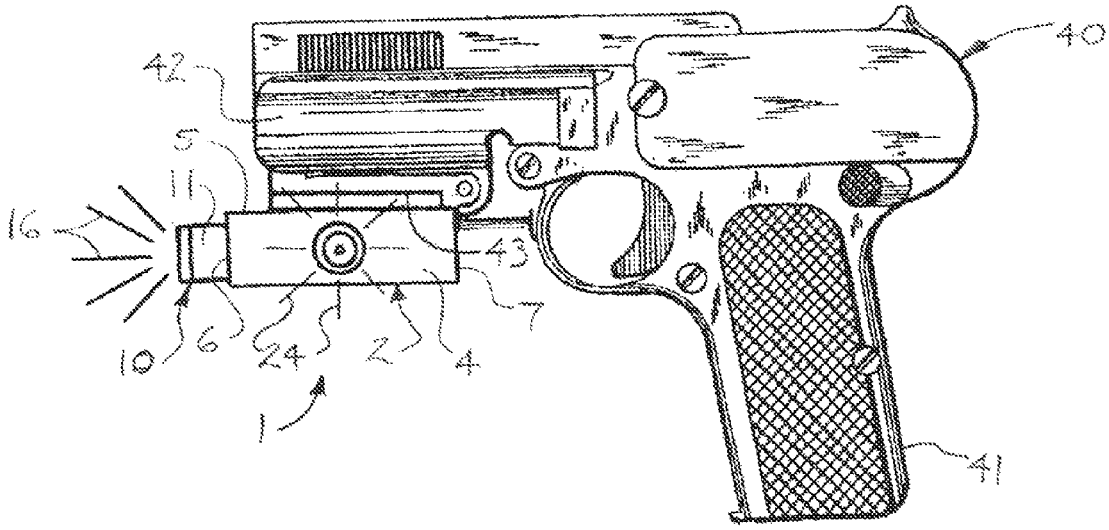
FIG. 6 is a side view of a firearm with an illustrative embodiment of the multi-directional firearm light mounted on an accessory mounting rail of the firearm and more particularly illustrating illumination of the front light and a side light of the multi-directional firearm light.
Figure 7:
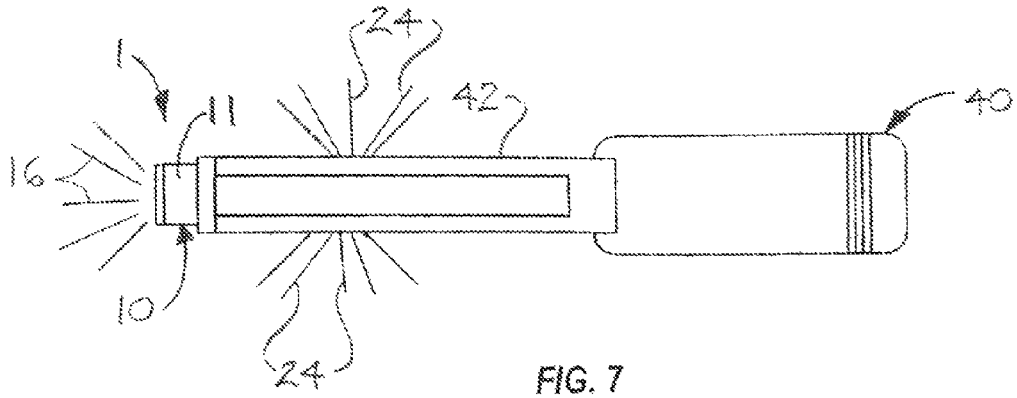
FIG. 7 is a top view of a firearm with an illustrative embodiment of the multi-directional firearm light mounted on an accessory mounting rail of the firearm and more particularly illustrating illumination of the front light and the side lights of the multi-directional firearm light.

Referring next to FIGS. 6 and 7 of the drawings, in exemplary application, the firearm light 1 is attached to a firearm 40 to illuminate the front and one or both sides of the firearm 40 during use of the firearm 40 in a dimly-lit or dark environment. Accordingly, the firearm 40 may include a firearm grip 41 and a firearm barrel 42 extending from the firearm grip 41. An accessory mounting rail 43 may be mounted on the firearm barrel 42. The accessory mounting rail 43 may be a conventional accessory mounting rail which is used to attach any of various accessories such as scopes, cameras and lights to the firearm 40. In some applications the firearm 40 may be a pistol, in which case the accessory mounting rail 43 may be mounted on the bottom of the accessory mounting rail 43, as illustrated.

The firearm light 1 may be attached to the firearm 40 by slidably engaging the light mount rails 38 on the firearm light housing 2 of the firearm light 1 with the companion accessory mounting rail 43 on the firearm barrel 42 of the firearm 40. The front light switch 15 may be manipulated to energize the front light 10 and the rear light switch 32 may be manipulated to energize either or both of the side lights 18. Accordingly, the front light 10 emits a front light beam 16 into the area in front of the firearm 40 to illuminate a potential target or targets in front of the firearm 40. The side lights 18 emit side light beams 24 into the blind spot areas which are on the respective sides of the firearm 40 and lie outside the cone or illumination field of the front light beam 16 to illuminate potential targets on the respective sides of the firearm 40. In some applications (such as in police work or military applications), the front light beam 16 may illuminate a potentially dangerous person or persons in front of the user as the user holds the firearm 40. Similarly, the side light beams 24 may illuminate a potentially dangerous person or persons at the sides of the firearm 40. The user of the firearm 40 can then take protective action against the potentially dangerous person or persons with the firearm 40 as deemed necessary.

It will be appreciated by those skilled in the art that the firearm light can be used by military personnel, police and SWAT teams as well as ordinary citizens for personal protection particularly in a dark or dimly lit environment. The firearm light significantly enhances the visual field of the user of a firearm particularly in close or confined quarters in which potentially armed and dangerous persons may be hiding. The firearm light provides a user of the firearm with a full view of his or her surroundings at close range without the user having to pan or point the firearm to the left or right. The firearm light can be offered as an accessory to conventional firearms and is compatible with existing conventional accessory mounting rails on firearms. Thus, the firearm light is transferrable between pistols and rifles. The firearm light may be fabricated in a size which will easily fit into a standard-sized gun holster (not illustrated). Moreover, it will be further appreciated by those skilled in the art that the glare of the side light beams which are emitted by the side lights of the firearm light 1 may "blind" a potentially dangerous person who hides or stands to either side of the firearm, providing the user of the firearm with a tactical advantage in military, police and home-defense scenarios. In alternative embodiments of the firearm light, a bottom light (not illustrated) may be provided in the firearm light housing for illumination of the floor beneath the firearm light. In some applications, the firearm light may be removed from the firearm and used as a multi-directional flashlight. The firearm light housing 2 may be square, rectangular, cylindrical or any other shape which is consistent with the functional requirements of the firearm light 1.

While the embodiments of the disclosure have been described above, it will be recognized and understood that various modifications can be made and the appended claims are intended to cover all such modifications which may fall within the spirit and scope of the disclosure.

What is claimed is:

1. A multi-directional firearm light, comprising:

a firearm light housing;

at least one light mount rail carried by the firearm light housing;

a front light carried by the firearm light housing;

at least one side light pivotally carried by the firearm light housing and selectively positional throughout a range of angles with respect to the front light, the at least one side light operable to continuously illuminate areas adjacent to the firearm light housing throughout the range of angles;

a power source connected to the front light and the at least one side light; and at least one switch connected to the front light, the at least one side light and the power source.

2. The multi-directional firearm light of claim 1 wherein the at least one side light comprises a pair of side lights on respective sides of the firearm light housing.

3. The multi-directional firearm light of claim 1 wherein the range of angles comprises an angle of about 45 degrees with respect to the front light.

4. The multi-directional firearm light of claim 1 wherein the range of angles comprises an angle of about 90 degrees with respect to the front light.

5. The multi-directional firearm light of claim 1 wherein the front light comprises a front light housing carried by the firearm light housing, a conical light reflective surface in the front light housing, a light bulb at a center of the light reflective surface and connected to the at least one switch and a transparent front light cover on the front light housing.

6. The multi-directional firearm light of claim 1 wherein the at least one side light comprises a side light housing carried by the firearm light housing, a conical light reflective surface in the side light housing, a light bulb at a center of the light reflective surface and connected to the at least one switch and a transparent front light cover on the side light housing.

7. The multi-directional firearm light of claim 1 wherein the at least one switch comprises a first switch connected to the front light and a second switch connected to the at least one side light.

8. A multi-directional firearm light, comprising:

a firearm light housing;

a pair of side light openings in respective sides of the firearm light housing;

at least one light mount rail carried by the firearm light housing;

a front light carried by the firearm light housing;

a pair of side lights pivotally carried by the firearm light housing in the respective side light openings, each of the pair of side lights pivotal about a center axis of a corresponding one of each of the pair of side lights and selectively positional throughout a range of angles with respect to the front light, each of the pair of side lights operable to continuously illuminate areas adjacent to the firearm light housing throughout the range of angles;

a power source connected to the front light and the pair of side lights; and at least one switch connected to the front light, the pair of side lights and the power source.

9. The multi-directional firearm light of claim 8 wherein each of the pair of side lights is generally flush with an exterior surface of the firearm light housing.

10. The multi-directional firearm light of claim 8 wherein the range of angles comprises an angle of about 45 degrees with respect to the front light.

11. The multi-directional firearm light of claim 8 wherein the range of angles comprises an angle of about 90 degrees with respect to the front light.

12. The multi-directional firearm light of claim 8 wherein the front light comprises a front light housing carried by the firearm light housing, a conical light reflective surface in the front light housing, a light bulb at a center of the light reflective surface and connected to the at least one switch and a transparent front light cover on the front light housing.

13. The multi-directional firearm light of claim 8 wherein the at least one side light comprises a side light housing carried by the firearm light housing, a conical light reflective surface in the side light housing, a light bulb at a center of the light reflective surface and connected to the at least one switch and a transparent front light cover on the side light housing.

14. The multi-directional firearm light of claim 8 wherein the at least one switch comprises a first switch connected to the front light and a second switch connected to the at least one side light.

15. A multi-directional firearm light, comprising:

a generally elongated firearm light housing having a bottom housing panel, side housing panels extending from the bottom housing panel, a top housing panel carried by the side housing panels and front and rear housing panels on the bottom housing panel, the side housing panel and the rear housing panel;

at least one light mount rail carried by the top housing panel of the firearm light housing;

a pair of side light openings in respective side housing panels of the firearm light housing;

a front light carried by the front housing panel of the firearm light housing;

a pair of side lights pivotally carried by the firearm light housing in the pair of side light openings, respectively, of the firearm light housing and each pivotal about a center axis of a corresponding one of each of the pair of side lights and selectively positional throughout a range of angles between about 20 degrees and about 90 degrees with respect to the front light, each of the pair of side lights operable to continuously illuminate areas adjacent to the firearm light housing throughout the range of angles;

each of the pair of side lights having a cylindrical side light housing, a conical light reflective surface in the side light housing and a transparent side light cover extending over the light reflective surface, the side light cover generally flush with an exterior surface of the firearm light housing when each of the pair of side lights is positioned at about 90 degrees with respect to the front light;

a power source connected to the front light and the side lights; and at least one switch connected to the front light, the side lights and the power source.

* * * * *